US010519825B2

(12) United States Patent
Achiwa

(10) Patent No.: US 10,519,825 B2
(45) Date of Patent: Dec. 31, 2019

(54) CRANKSHAFT LUBRICATING OIL PASSAGE STRUCTURE FOR V-TYPE ENGINE

(71) Applicant: SUZUKI MOTOR CORPORATION, Shizuoka-Ken (JP)

(72) Inventor: Tetsushi Achiwa, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 24 days.

(21) Appl. No.: 15/945,377

(22) Filed: Apr. 4, 2018

(65) Prior Publication Data

US 2018/0291779 A1 Oct. 11, 2018

(30) Foreign Application Priority Data

Apr. 5, 2017 (JP) ..... 2017-074903

(51) Int. Cl.

| | |
|---|---|
| ***F01M 11/02*** | (2006.01) |
| ***F02B 75/22*** | (2006.01) |
| ***F02B 61/04*** | (2006.01) |
| ***F01N 13/00*** | (2010.01) |
| ***F02D 35/02*** | (2006.01) |

(52) U.S. Cl.

CPC ..... *F01M 11/02* (2013.01); *F01N 13/004* (2013.01); *F02B 61/045* (2013.01); *F02B 75/228* (2013.01); *F01M 2011/026* (2013.01); *F02D 35/027* (2013.01)

(58) Field of Classification Search

CPC ..... F01M 11/02; F01M 2011/026; F01N 13/004; F01N 2590/021; F02B 61/045; F02B 75/22; F02B 75/228

See application file for complete search history.

(56) References Cited

U.S. PATENT DOCUMENTS

| | | | | |
|---|---|---|---|---|
| 4,598,681 A * | 7/1986 | Hayashi | F02B 77/085 | 123/195 H |
| 4,840,152 A * | 6/1989 | Watanabe | F02B 61/045 | 123/184.31 |
| 5,690,062 A * | 11/1997 | Yamada | F01M 5/002 | 123/196 AB |
| 5,911,610 A * | 6/1999 | Fujimoto | B63H 20/245 | 440/89 H |

FOREIGN PATENT DOCUMENTS

| | | |
|---|---|---|
| JP | H01313653 A | 12/1989 |
| JP | 2007032278 A | 2/2007 |

* cited by examiner

*Primary Examiner* — Audrey K Bradley
*Assistant Examiner* — Anthony Ayala Delgado
(74) *Attorney, Agent, or Firm* — Barnes & Thornburg LLP

(57) ABSTRACT

A crankshaft lubricating oil passage structure of a V-shaped engine includes a main oil passage and a sub oil passage. The V-shaped engine includes a pair of banks. The pair of banks includes cylinders and is disposed in a V shape with respect to the crankshaft. The V bank angle as an included angle of the cylinders of the respective banks is set at a narrow angle. The main oil passage is provided between the pair of banks in the cylinder block or the crankcase. The sub oil passage extends from the main oil passage to the bearing portion of the crankshaft and guides lubricating oil to the bearing portion. The main oil passage is formed by connecting divided passage portions that are divided partway in an axial direction by an oil passage connection member that is a separate member from the cylinder block or the crankcase.

4 Claims, 7 Drawing Sheets

CRANKSHAFT LUBRICATING OIL PASSAGE STRUCTURE FOR V-TYPE ENGINE

CROSS-REFERENCE TO RELATED APPLICATIONS

This application claims the benefit of priority of Japanese Patent Application No. 2017-074903, filed Apr. 5, 2017, the entire contents of which are incorporated herein by reference.

BACKGROUND OF THE INVENTION

Field of the Invention

The present invention relates to a crankshaft lubricating oil passage structure for a V-type engine.

Description of the Related Art

It is a well-known conventional technique to dispose cylinders in a V shape to form a V-type engine as an engine layout that reduces an engine dimension in a longitudinal direction of a crankshaft as much as possible at a time of increasing an engine displacement. In the case of loading the V-type engine on an outboard motor, it is important how to reduce a dimension in a width direction (a left-right direction orthogonal to a traveling direction of a hull when the outboard motor is loaded on the hull).

This is because when a plurality of (for example, two) outboard motors are provided side by side on a transom of a hull, maneuverability of the hull is affected, when the outboard motors have large dimensions in the width directions. Consequently, a V-type engine that is loaded on an outboard motor needs to be an engine in which an influence on the maneuverability of the hull is reduced as much as possible by setting a V bank angle at a narrow angle.

In the V-type engine like this, especially in the case where the cylinder diameter of the cylinder in each of the banks is set to be large, there arises a problem about the structure of the oil passage that supplies a lubricating oil from a cylinder block side to bearing portions (crank journal portions) of a crankshaft provided in a cylinder block. Normally, the oil passage structure is configured by forming a single continuous main oil passage from one side of the cylinder block to an opposite side, and forming sub oil passages that guide the lubricating oil to the respective crank journal portions from the main oil passage, as described in Patent Document 1 (Japanese Patent Laid-Open No. H01-313653).

In a V-type engine which is loaded on an outboard motor, a knock sensor is also installed in accordance with necessity, knocking that occurs to the engine is detected by the knock sensor, and knocking prevention control is carried out based on the detection result, whereby engine performance is enhanced. In the V-type engine, a knock sensor is generally installed between a pair of banks in a cylinder block, for example, as described in Patent Document 2 (Japanese Patent Laid-Open No. 2007-032278).

Incidentally, when a V bank angle of a pair of banks is set at a narrow angle of 90 degrees or less in a V-type engine in an outboard motor, especially when the cylinder diameters of the cylinders of the respective banks are large, it becomes difficult to form a continuous single main oil passage with a necessary passage diameter between a pair of banks in the cylinder block. The aforementioned difficulty is further enhanced when the V bank angle is set at a much narrower angle to reduce a dimension in a width direction of the outboard motor in a V-type engine in which a catalyst for purifying exhaust gas is disposed in an exhaust passage in a cylinder block.

When a continuous single main oil passage of a necessary passage diameter cannot be formed as described above, it is necessary to form an oil passage that supplies a lubricating oil to a crank journal portion relating to a cylinder at a central portion side by some measures in the case of an engine in which three or more cylinders are disposed in each of the banks of a V-type engine.

Further, when a knock sensor is installed between a pair of banks in the cylinder block of a V-type engine, there is a low possibility that an external force acts on the knock sensor during an operation of the engine and influences durability of the knock sensor, but a worker may apply an external force erroneously to the knock sensor during maintenance of the engine. A large outboard motor with a large displacement is used at sea where a use environment is more severe as compared with an automobile and the like that are used on land, so that the frequency of maintenance of the engine is higher as compared with an automobile. Accordingly, there is a fear of increase of the frequency of an external force being erroneously applied to the knock sensor during maintenance of the engine which is frequently performed.

Further, in the V-type engine where the V bank angle is set at a narrow angle, the main oil passage and the knock sensor are installed between the pair of banks in the cylinder block, so that the knock sensor tends to be disposed in a vicinity of the main oil passage. Consequently, a knocking signal at the time of occurrence of knocking is attenuated by the lubricating oil in the main oil passage, and reception sensitivity to the knocking signal by the knock sensor is reduced. Consequently, detection precision of knocking by the knock sensor is reduced, and there is a possibility of being incapable of favorably carrying out knocking prevention control of the V-type engine.

SUMMARY OF THE INVENTION

The present invention is made in consideration of the aforementioned circumstances, and it is an object of the present invention to provide a crankshaft lubricating oil passage structure for a V-type engine that can ensure an oil passage that guides a lubricating oil to bearing portions of a crankshaft with a simple structure even when a V bank angle of the V-type engine is a narrow angle.

Further, another object of the present invention is to provide a crankshaft lubricating oil passage structure for a V-type engine that can detect knocking that occurs to the V-type engine by a knocking sensor at low cost with high precision.

The above and other objects can be achieved according to the present invention by providing, in one aspect, a crankshaft lubricating oil passage structure of a V-shaped engine, which supplies lubricating oil to a bearing portion of a crankshaft provided in a cylinder block or a crankcase, includes a main oil passage and a sub oil passage. The V-shaped engine includes a pair of banks. The pair of banks includes cylinders and is disposed in a V shape with respect to the crankshaft. The V bank angle as an included angle of the cylinders of the respective banks is set at a narrow angle. The main oil passage is provided between the pair of banks in the cylinder block or the crankcase. The sub oil passage extends from the main oil passage to the bearing portion of the crankshaft and guides the lubricating oil to the bearing portion. The main oil passage is formed by connecting divided passage portions that are divided partway in an axial direction by an oil passage connection member that is a separate member from the cylinder block or the crankcase.

When the V-bank angle of a V-type engine is a narrow angle, a wall thickness of a region between a pair of banks in a cylinder block or a crankcase is thin, and it is difficult to form a continuous single main oil passage with a necessary passage diameter in the thin portion. According to the present invention, the main oil passage is configured by connecting divided passage portions divided partway in an axial direction by an oil passage connection member that is a separate member from the cylinder block or the crankcase. Thereby, even when the V bank angle of the V-type engine is a narrow angle, an oil passage that guides lubricating oil to bearing portions of a crankshaft can be ensured with a simple structure.

The nature and further characteristic features of the present invention will be described hereinafter in the following descriptions made with reference to the accompanying drawings, and the other advantages effects and functions of the present invention will be also made clear hereinafter.

DETAILED DESCRIPTION

Hereinafter, the embodiment for carrying out the present invention will be described based on the drawings.

Figure 1:
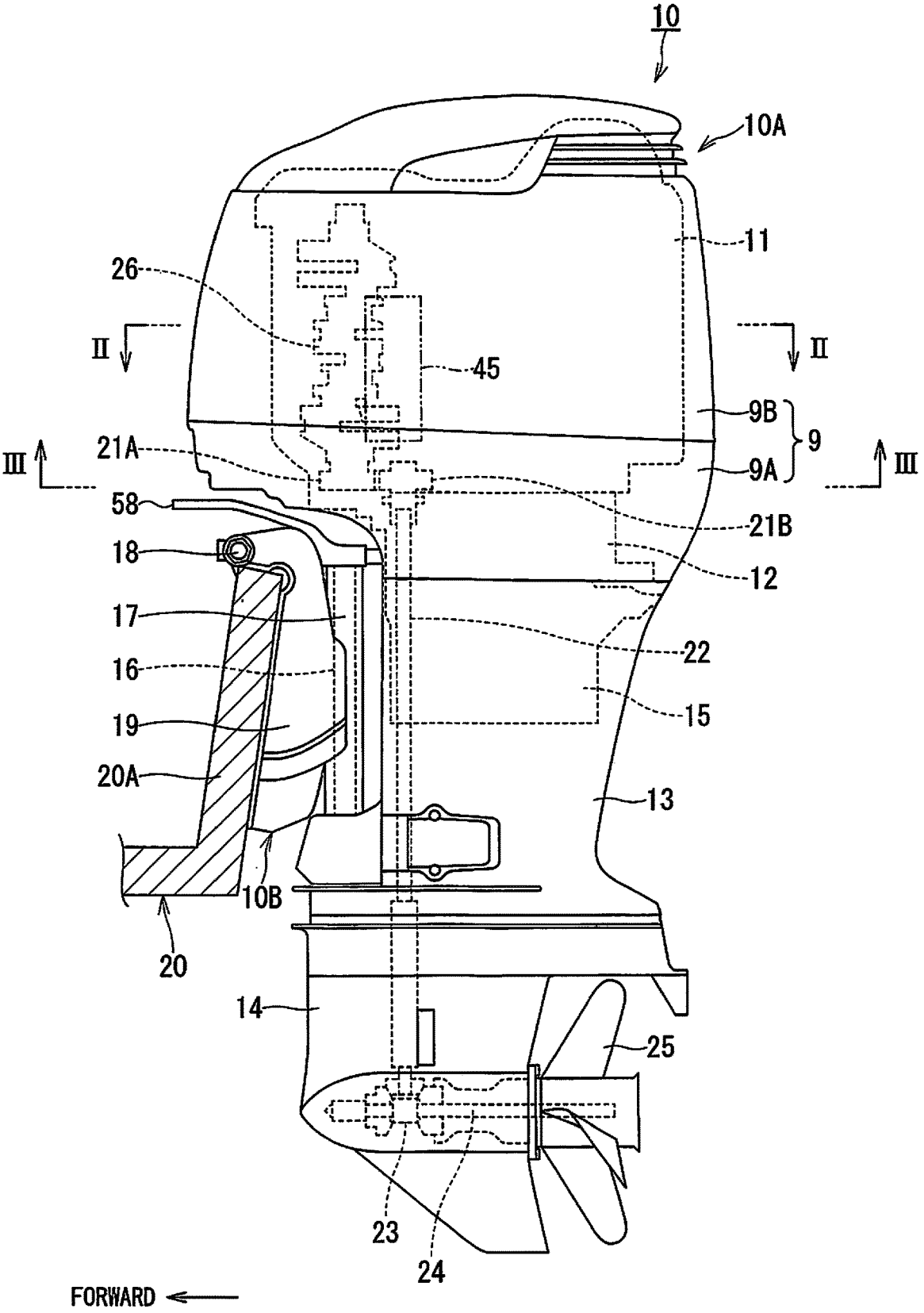
FIG. 1 is a left side view illustrating an outboard motor to which one embodiment in a crankshaft lubricating oil passage structure for a V-type engine according to the present invention is applied.

FIG. 1 is a left side view illustrating an outboard motor to which one embodiment in a crankshaft lubricating oil passage structure for a V-type engine according to the present invention is applied. An outboard motor 10 illustrated in FIG. 1 is configured by having an outboard motor body 10A that is loaded with an engine 11 and includes a propeller 25 (described later), and an attaching bracket device 10B as an attaching device that is installed at a front part of the outboard motor body 10A and attaches the outboard motor body 10A to a hull 20 to be attachable and detachable.

The outboard motor body 10A includes an engine holder 12, and the engine 11 is loaded on a top portion of the engine holder 12. The engine 11 is a vertical type engine in which a crankshaft 26 (described later) is disposed substantially vertically. Below the engine holder 12, a drive shaft housing 13 and a gear case 14 are sequentially assembled.

Reference sign 15 in FIG. 1 denotes an oil pan that is disposed below the engine holder 12 and stores lubricating oil. Reference sign 9 denotes an engine cover (a lower engine cover 9A, an upper engine cover 9B) that covers the engine 11 and the engine holder 12 and can be divided up and down.

Further, the outboard motor body 10A is supported rotatably in a horizontal direction by a steering shaft 16 being pivotally supported by a swivel bracket 17, the swivel bracket 17 is rotatably supported in the vertical direction with respect to a clamp bracket 19 via a swivel shaft 18, and the cramp bracket 19 is attached to a transom 20A of the hull 20. Thereby, the attaching bracket device 10B supports the outboard motor body 10A rotatably in the horizontal direction (a steering direction) via the steering shaft 16 and in the vertical direction (a trim and tilt directions) via the swivel shaft 18 respectively, with respect to the hull 20.

A drive force occurring to the crankshaft 26 of the engine 11 is transmitted to a driveshaft 22 placed in a substantially vertical direction in the drive shaft housing 13 and the gear case 14 through reduction gears 21A and 21B, and is transmitted to the propeller 25 through a shift mechanism 23 and a propeller shaft 24 that are placed in the gear case 14 to rotate the propeller 25 in forward and reverse directions. Thereby, the outboard motor 10 causes the hull 20 to travel forward or travel rearward.

Here, the driveshaft 22 of the outboard motor body 10A is disposed parallel with the steering shaft 16. Further, the reduction gears 21A and 21B perform a function of disposing the driveshaft 22 of the outboard motor body 10A by offsetting the driveshaft 22 rearward in a longitudinal direction of the outboard motor 10, with respect to the crankshaft 26 of the engine 11.

Figure 2:
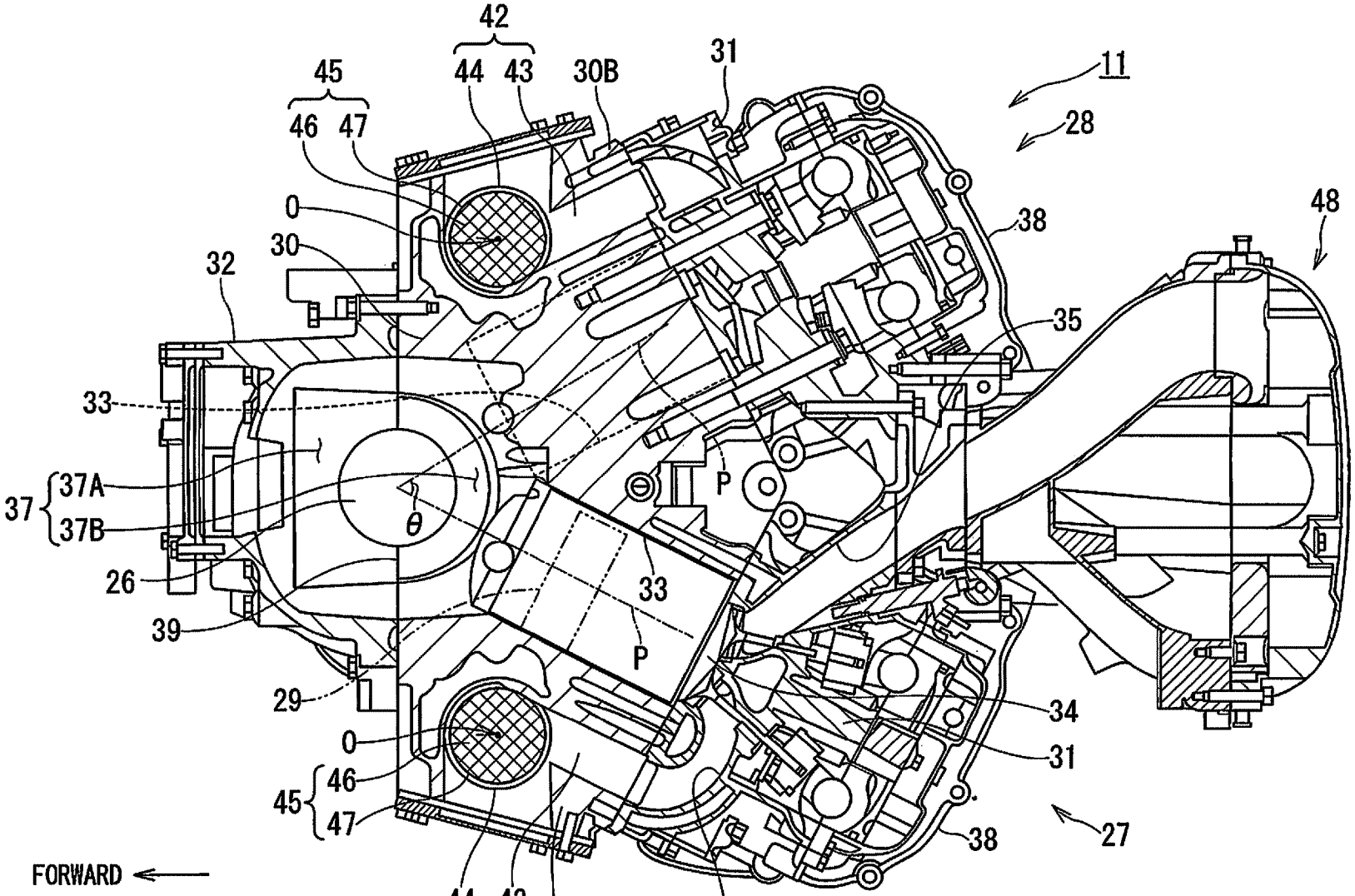
FIG. 2 is a sectional view taken along line II-II in FIG. 1.

As illustrated in FIGS. 1 and 2, the engine 11 is a V-type four-cycle engine having the crankshaft 26 extending in the vertical direction, and a pair of banks (that is, a left bank 27 that extends obliquely leftward to a rear, a right bank 28 that extends obliquely rightward to the rear) that are disposed in a V shape with respect to the crankshaft 26. In the V-type four-cycle engine, a cylinder head 31 and a head cover 38 are sequentially disposed behind a left bank portion 30A of a cylinder block 30 to configure the left bank 27, the cylinder head 31 and the head cover 38 are sequentially disposed behind a right bank portion 30B of the cylinder block 30 to configure the right bank 28, and a crankcase 32 is disposed in front of the cylinder block.

Figure 5:
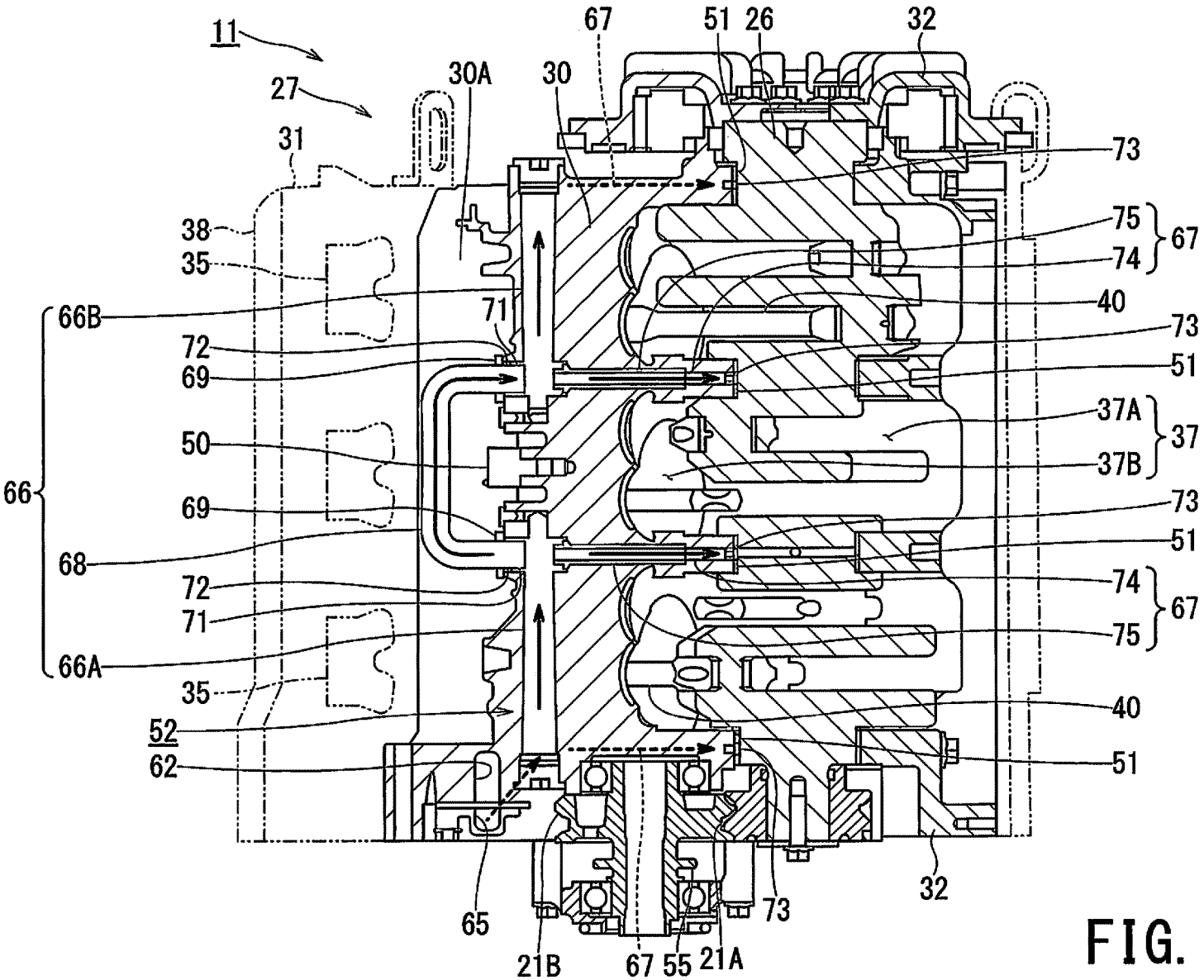
FIG. 5 is a sectional view taken along line V-V in FIG. 4.

As illustrated in FIG. 2, a cylinder 33 is formed inside the left bank portion 30A of the cylinder block 30 to extend in the horizontal direction and obliquely leftward to the rear. Further, the cylinder 33 is formed inside the right bank portion 30B of the cylinder block 30 to extend in the horizontal direction and obliquely rightward to the rear. Pistons 29 are placed in these cylinders 33 to be capable of reciprocating, and the pistons 29 are connected to the crankshaft 26 via connecting rods 40 (FIG. 5).

The cylinder heads 31 are fixed to the left bank portion 30A and the right bank portion 30B to cover the cylinders 33 along cylinder axes P of the respective cylinders 33 of the left bank portion 30A and the right bank portion 30B in the cylinder block 30, and simultaneously form combustion chambers 34 with the respective cylinders 33 of the left bank portion 30A and the right bank portion 30B.

Further, in the cylinder heads 31, intake ports 35 that communicate with the combustion chambers 34 are formed inward in an outboard motor width direction from the cylinder axes P of the cylinders 33 in the left bank portion 30A and the right bank portion 30B of the cylinder block 30. Further, in the cylinder heads 31, exhaust ports 36 that communicate with the combustion chambers 34 are formed outward in the outboard motor width direction from the cylinder axes P of the cylinders 33 in the left bank portion 30A and the right bank portion 30B of the cylinder block 30. Here, the width direction of the outboard motor is a lateral direction of the outboard motor 10 that is orthogonal to a traveling direction of the hull 20 when the outboard motor 10 is loaded on the hull 20.

The crankcase 32 is connected to the cylinder block 30, whereby the crankcase 32 forms a crank chamber 37 between the crankcase 32 and the cylinder block 30, and the crankshaft 26 is housed in the crank chamber 37. The crank chamber 37 can be divided on a parting surface 39 passing through a center line of the crankshaft 26, and is configured by a front half portion 37A that is formed in the crankcase 32, and a rear half portion 37B that is formed in the cylinder block 30.

Here, a plurality of cylinders each including the cylinder 33, the combustion chamber 34, the intake port 35 and the exhaust port 36 are provided side by side in the vertical direction, in each of the left bank 27 and the right bank 28 described above. In the present embodiment, three cylinders are provided side by side in the vertical direction in each of the left bank 27 and the right bank 28, and the engine 11 is configured as a V-type six-cylinder four-cycle engine.

In the left bank 27, a left exhaust passage 41 is provided outside in the outboard motor width direction from the cylinder 33. The left exhaust passage 41 communicates with the respective exhaust ports 36 of the plurality of cylinders provided in the left bank 27, includes a catalyst converter 45 (described later) inside, and guides exhaust gas exhausted from the respective exhaust ports 36 to outside of the engine 11. Further, in the right bank 28, a right exhaust passage 42 is provided outside in the outboard motor width direction from the cylinder 33. The right exhaust passage 42 communicates with the respective exhaust ports 36 of the plurality of cylinders provided in the right bank 28, includes the catalyst converter 45 inside, and guides exhaust gas that is exhausted from the respective exhaust ports 36 to outside of the engine 11.

The left exhaust passage 41 is formed integrally in the left bank portion 30A in the cylinder block 30, and the right exhaust passage 42 is formed integrally in the right bank portion 30B in the cylinder block 30. Further, the left exhaust passage 41 is disposed inside from an outline of the cylinder head 31 that configures the left bank 27 in the outboard machine width direction. The right exhaust passage 42 is disposed inside from an outline of the cylinder head 31 that configures the right bank 28 in the outboard motor width direction. Further, the left exhaust passage 41 and the right exhaust passage 42 are each configured by having an exhaust manifold 43 as a first exhaust passage and a catalyst housing chamber 44 as a second exhaust passage.

The exhaust manifold 43 is provided at least one side portion in a width direction in the cylinder block 30, at both side portions in the present embodiment. That is, the exhaust manifold 43 of the left exhaust passage 41 corresponds to the left bank 27, and is provided in an outer side portion of a left side (the left bank portion 30A) in the width direction of the cylinder block 30, and the exhaust manifold 43 of the right exhaust passage 42 corresponds to the right bank 28, and is provided in an outer side portion of a right side (the right bank portion 30B) in the width direction of the cylinder block 30. These exhaust manifolds 43 cause exhaust gas that is exhausted from the respective exhaust pots 36 of the plurality of cylinders to gather to lead the exhaust gas to the catalyst housing chamber 44.

The catalyst housing chamber 44 of the left exhaust passage 41 is integrally formed in the left bank portion 30A of the cylinder block 30, and the catalyst housing chamber 44 of the right exhaust passage 42 is integrally formed in the right bank portion 30B of the cylinder block 30 to be respectively substantially circular in passage sections. The catalyst housing chambers 44 connect the exhaust manifolds 43 to an exhaust silencing chamber (not illustrated) in the drive shaft housing 13 provided outside of the engine 11 and illustrated in FIG. 1. In the catalyst housing chamber 44, the catalyst converter 45 circular in section, for example, is installed and housed as a catalyst for purifying exhaust gas.

The catalyst converter 45 is configured by a catalyst carrier 46, for example, in a columnar shape having an exhaust purifying function being housed in a catalyst pipe 47 in a cylindrical shape, for example. The catalyst carrier 46 chemically changes harmful components such as a carbon monoxide, a hydrocarbon and a nitrogen oxide contained in exhaust gas to water, a carbon dioxide, nitrogen and the like by an oxidation-reduction reaction by contacting the exhaust gas.

Accordingly, exhaust gas that are generated in the combustion chambers 34 of a plurality of cylinders in each of the left bank 27 and the right bank 28 of the engine 11 illustrated in FIG. 2 flows in the exhaust ports 36 of the respective cylinders in each of the left bank 27 and the right bank 28, and flows into the exhaust manifold 43 in each of the left exhaust passage 41 and the right exhaust passage 42. The exhaust gas which flows into the exhaust manifold 43 reverses a flow to a downward direction, and flows into the catalyst converter 45 in the catalyst housing chamber 44 to be purified.

The exhaust gas which is purified by the catalyst converter 45 flows downward in an exhaust passage (not illustrated) in the engine holder 12 illustrated in FIG. 1, flows into the exhaust silencing chamber in the driveshaft housing 13 to expand and is silenced. Thereafter, the exhaust gas flows in an exhaust passage (not illustrated) that is formed around the propeller shaft 24 in the gear case 14, and is discharged into water from a center of the propeller 25.

Note that reference sign 48 in FIG. 2 denotes an intake manifold that is connected to the intake port 35 in the engine 11 and guides mixture gas of fuel and air to the combustion chamber 34 through the intake port 35.

Figure 6:
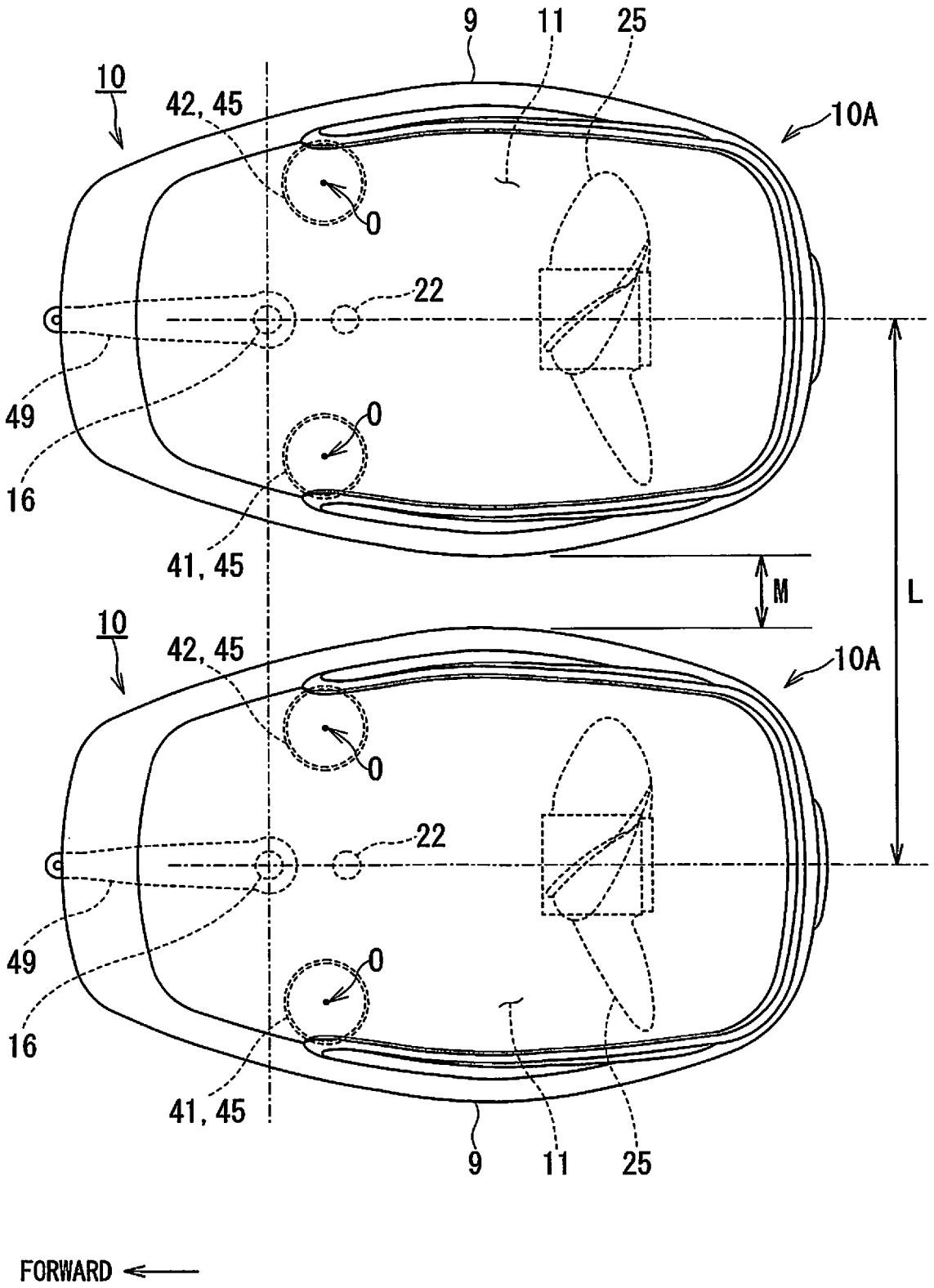
FIG. 6 is a plan view of two outboard motors illustrating a state where the two of the outboard motors in FIG. 1 are provided side by side on a hull, and cause the hull to travel rectilinearly.

Incidentally, as illustrated in FIGS. 1 and 6, when a plurality of outboard motors 10 are provided side by side on the transom 20A of the hull 20, a case where a plurality of outboard motors 10 are close to each other is more preferable than a case where the plurality of outboard motors 10 are apart from each other, in the viewpoint of enhancing turning performance of the hull 20. That is, if the hull 20 is turned when the plurality of outboard motors 10 are away from one another, the hull 20 inclines to be low to the turning center side, whereby the propeller 25 of the outboard motor 10 at the turning center outer side at the time of turning reaches a vicinity of a water surface to involve air and a thrust force is reduced.

In contrast with this, even when the hull 20 is turned in the case of the plurality of outboard motors 10 are close to each other, and the hull 20 inclines to be low to the turning center side, the propeller 25 of the outboard motor 10 at the turning center outer side at the time of turning is at a position deeper than the water surface and can ensure a thrust force without involving air. The thrust force of the outboard motor 10 at the outer side of the turning center acts on an outside of the center of gravity of the hull 20 at the time of turning and generates a turning moment, and therefore contributes to enhancement of the turning performance of the hull 20.

As illustrated in FIG. 6, in the engine cover 9 of the outboard motor body 10A, portions including portions corresponding to the left exhaust passage 41 and the right exhaust passage 42 of the engine 11 are bulged outward in the outboard motor width direction. When the plurality of outboard motors 10 are provided side by side at an installation interval L on the transom 20A of the hull 20, a space between maximum swelling spots of the engine covers 9 of the outboard motor main bodies 10A is a space M in the outboard motor width direction as illustrated in FIG. 6, at a time of rectilinear travel of the hull 20. Here, the installation interval L is a distance between the steering shafts 16 of the two outboard motors 10, for example.

Figure 7:
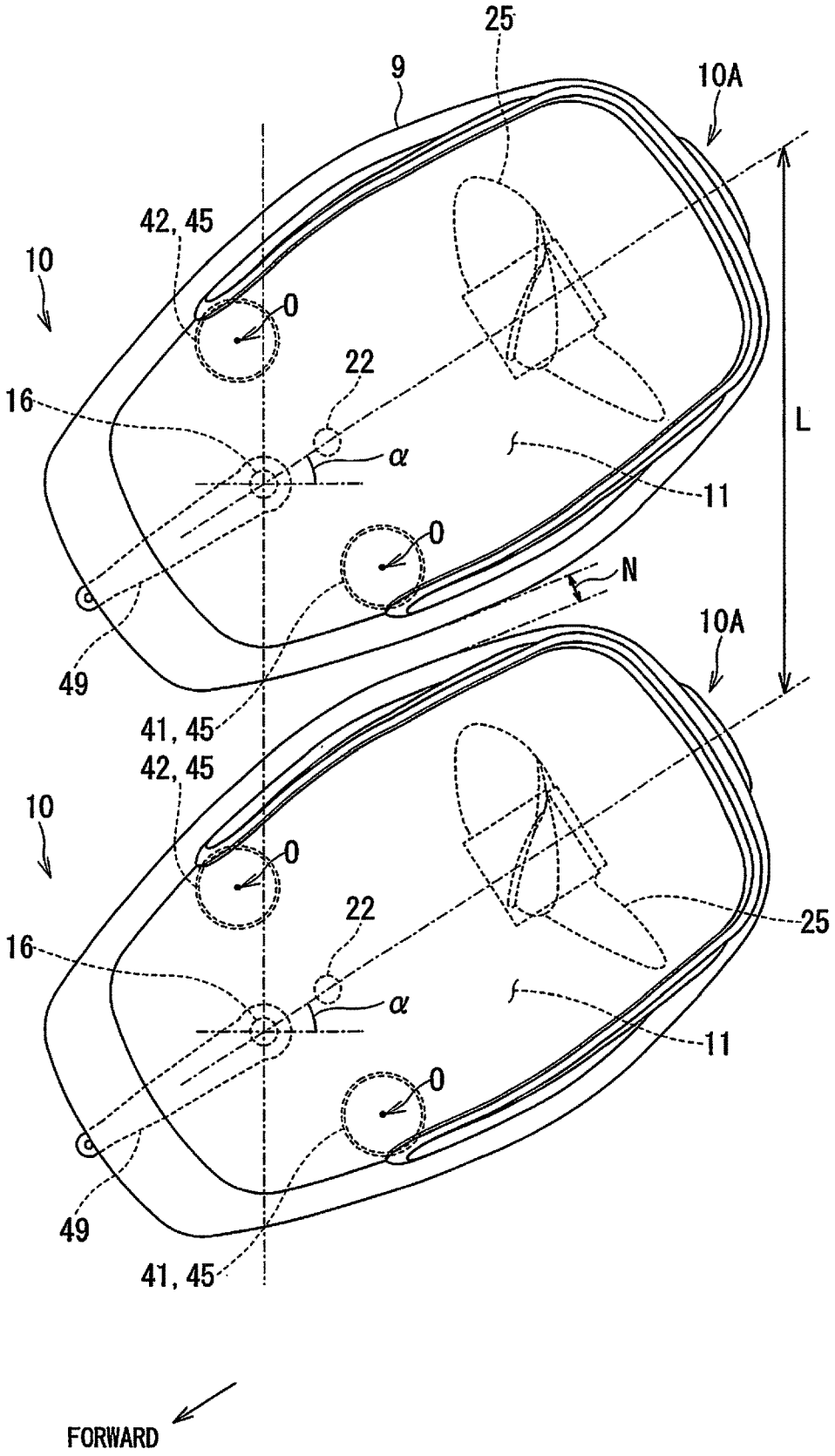
FIG. 7 is a plan view of two of the outboard motors in FIG. 1 illustrating a state where the two of the outboard motors in FIG. 1 are provided side by side on the hull, and cause the hull to turn.

In contrast with this, as illustrated in FIG. 7, at a time of turning of the hull 20 when the outboard motor bodies 10A are rotated in the horizontal direction around the steering shafts 16, a space between a front spot and a rear spot of the maximum swelling spots in the engine covers 9 of the outboard motor main bodies 10A is a space N in the outboard motor width direction. The space N is generally smaller than the above described space M. In the present embodiment, the left exhaust passage 41 and the right exhaust passage 42 of the engine 11 are installed to correspond to the front spots of the maximum swelling spots of the engine cover 9.

Accordingly, even when the plurality of outboard motors 10 are caused to be close to each other in order to enhance turning performance of the hull 20, and are provided side by side by setting the installation space L to be narrow, it is necessary to enhance maneuverability of the hull 20 by ensuring the space N between the outboard motor bodies 10A when the hull 20 is turned by giving steering angles $\alpha$ to the outboard motor bodies 10A of the outboard motors 10. For this purpose, it is important as one of countermeasures not to bulge the left exhaust passage 41 and the right exhaust passage 42 of the engine 11 in the outboard motor 10 outward in the width direction of the outboard motor 10. Here, reference sign 49 in FIGS. 6 and 7 denotes a steering bracket that is fixed to the steering shaft 16 to rotate the outboard motor body 10A in the horizontal direction around the steering shaft 16.

In the outboard motor 10 of the present embodiment, a V bank angle $\theta$ that is the included angle the cylinders 33 in the respective left bank 27 and right bank 28 in the engine (the V-type engine) 11 is set at a narrow angle of 90 degrees or less as illustrated in FIG. 2, whereby even when the catalyst converters 45 are disposed in the left exhaust passage 41 and the right exhaust passage 42, the left exhaust passage 41 and the right exhaust passage 42 are not bulged outward in the width direction of the outboard motor 10, and the dimension in the width direction of the outboard motor 10 is restrained. Consequently, as illustrated in FIGS. 1, 6 and 7, even when the plurality (for example, two) of outboard motors 10 are provided side by side on the transom 20A of the hull 20 to be close to each other, the space N is ensured in the width direction of the outboard motor between the outboard motor bodies 10A of the plurality of outboard motors 10 at the time of turning the hull by giving the steering angle $\alpha$ to the outboard motor bodies 10A. As a result, at the time of turning of the hull 20, interference of the outboard motor bodies 10A of the outboard motors 10 is prevented, and maneuverability of the hull 20 is enhanced.

Figure 4:
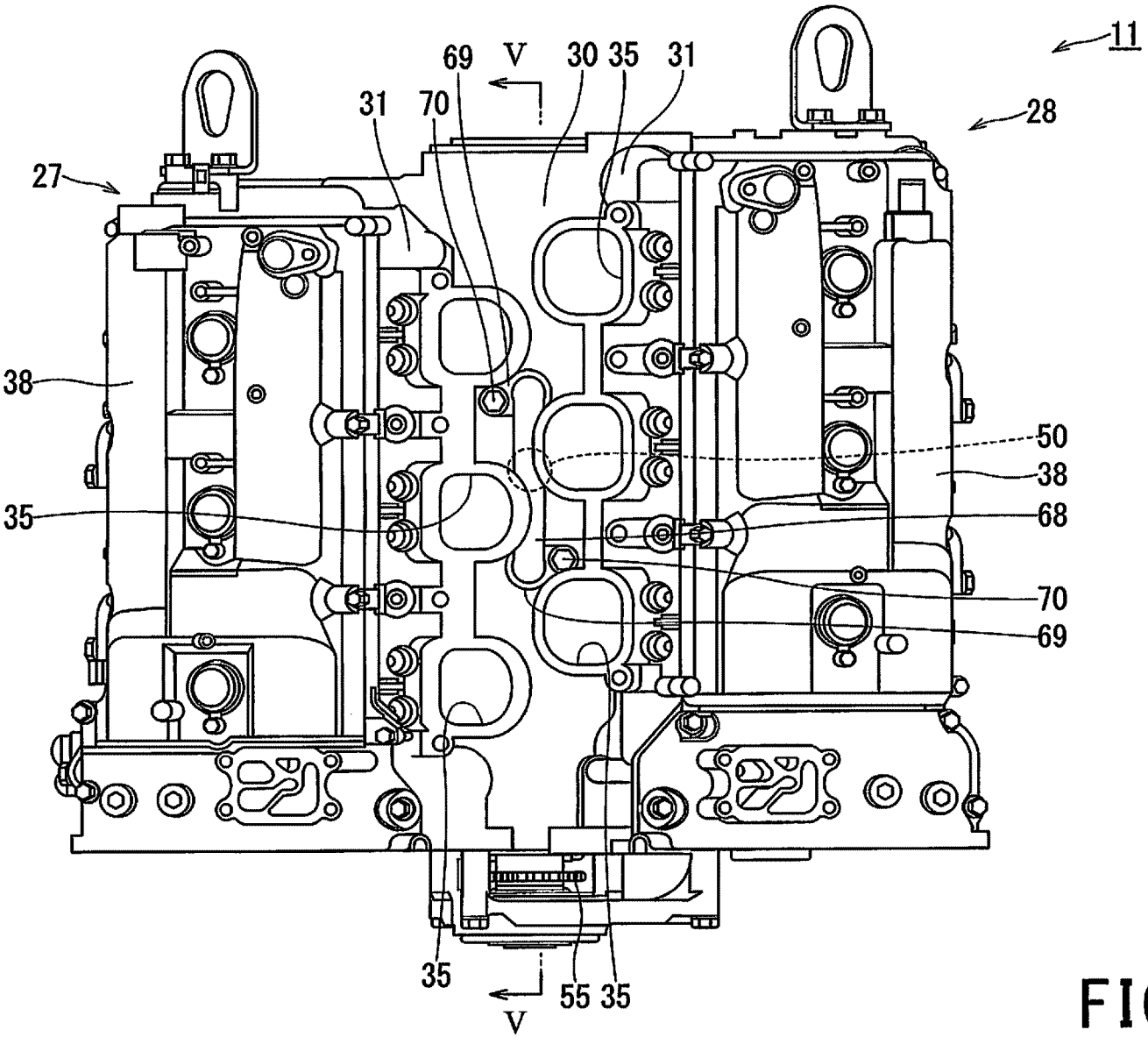
FIG. 4 is a view seen from arrow IV in FIG. 3.

Further, in the engine (the V-type engine) 11 of the outboard motor 10 of the present embodiment, as illustrated in FIGS. 4 and 5, a single knock sensor 50 is directly installed by screwed fixation in a central position in the vertical direction between the left bank 27 and the right bank 28 in the cylinder block 30. The knock sensor 50 receives a knocking signal from the engine (the V-type engine) 11, and detects knocking of all the cylinders of the engine 11. When knocking of the engine (the V-type engine) 11 is detected by the knock sensor 50, knocking prevention control of controlling ignition timing to a retardation side, for example, is carried out to enhance engine performance.

Figure 3:
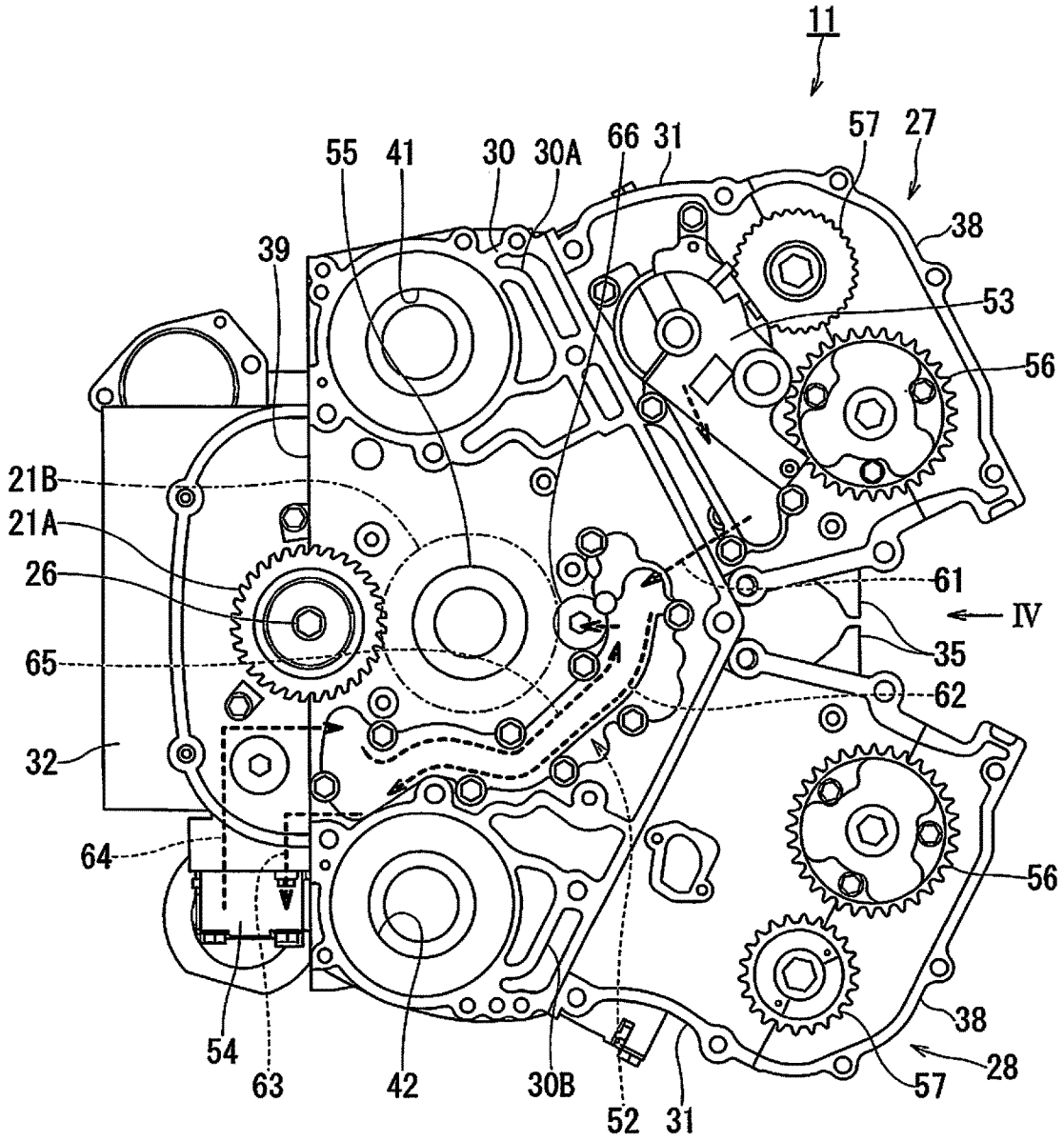
FIG. 3 is an arrow view seen from line in FIG. 1.

Further, the engine (the V-type engine) 11 of the outboard motor 10 of the present embodiment has a crankshaft lubricating oil passage structure 52 that supplies a lubricating oil from the cylinder block 30 side to bearing portions (crank journal portions 51) of the crankshaft 26 provided in the cylinder block 30 as illustrated in FIGS. 3 and 5. The crankshaft lubricating oil passage structure 52 is configured by including an oil pump 53, a first oil passage 61, a second oil passage 62, a third oil passage 63, an oil filter 54, a fourth oil passage 64, a fifth oil passage 65, a main oil passage 66 and sub oil passages 67.

The oil pump 53 is installed in a lower portion in the vertical direction in the cylinder head 31 which configures the left bank 27, as illustrated in FIG. 3, for example. As illustrated in FIGS. 3 and 5, a rotational drive force of the crankshaft 26 passes through reduction gears 21A and 21B that are meshed with each other and is transmitted to a cam drive sprocket 55 that is provided to integrally rotate with the reduction gear 21B. The rotational drive force which is transmitted to the cam drive sprocket 55 is transmitted to intake side cam driven sprockets 56 in the left bank 27 and the right bank 28 via first cam chains not illustrated, is further transmitted to exhaust side cam driven sprockets 57 in the left bank 27 and the right bank 28 via second cam chains (not illustrated), is further transmitted to the oil pump 53 via a drive chain (not illustrated) from an exhaust side cam driven sprocket side in the left bank 27, and drives the oil pump 53.

As illustrated in FIG. 3, the oil filter 54 is installed in a right outer side wall, for example, in a lower portion in the vertical direction in the crankcase 32. The first oil passage 61, the second oil passage 62 and the third oil passage 63 are formed to communicate with one another sequentially, and guide the lubricating oil from the oil pump 53 to the oil filter 54.

The first oil passage 61 among them is formed to connect to the oil pump 53, and continue to lower portions in the vertical direction of cylinder head 31 and the left bank portion 30A of the cylinder block 30 of the left bank 27. The second oil passage 62 is formed in a lower portion in the vertical direction of the cylinder block 30. The third oil passage 63 is formed in lower portions in the vertical direction of the cylinder block 30 and the crankcase 32, and is connected to the oil filter 54. The lubricating oil which is guided to the oil filter 54 through the first oil passage 61, the second oil passage 62 and the third oil passage 63 from the oil pump 53 has dust and the like removed in the oil filter 54.

As illustrated in FIG. 3, parts (an upstream side divided passage portion 66A, a downstream side divided passage portion 66B) of the main oil passage 66 are formed along the vertical direction, between the left bank 27 and the right bank 28 in the cylinder block 30. The fourth oil passage 64, the fifth oil passage 65 and the main oil passage 66 are formed sequentially to communicate with one another, and guide the lubricating oil from the oil filter 54 to the main oil passage 66.

The fourth oil passage 64 among them is formed to connect to the oil filter 54 and continue to lower portions in the vertical direction of the crankcase 32 and the cylinder block 30. The fifth oil passage 65 is formed in the lower portion in the vertical direction of the cylinder block 30 parallel with the second oil passage 62. The lubricating oil which has the dust and the like removed in the oil filter 54 is guided to the main oil passage 66 through the fourth oil passage 64 and the fifth oil passage 65.

As illustrated in FIG. 5, the upstream side divided passage portion 66A and the downstream side divided passage portion 66B which are divided to an upstream side and a downstream side partway in the axial direction are formed along the vertical direction of the cylinder block 30, and the main oil passage 66 is configured by the upstream side divided passage portion 66A and the downstream side divided passage portion 66B being connected by an oil passage connection member 68.

The oil passage connection member 68 is configured by a U-shaped pipe member, for example, that is a separate member from the cylinder block 30, and connects the upstream side divided passage portion 66A and the downstream side divided passage portion 66B in such a manner as to avoid the knock sensor 50. Thereby, the knock sensor 50 is interposed between the cylinder block 30 and the oil passage connection member 68. Subsequently, the lubricating oil that flows into the main oil passage 66 flows from the upstream side divided passage portion 66A to the downstream side divided passage portion 66B through the oil passage connection member 68.

As illustrated in FIGS. 4 and 5, the oil passage connection member 68 is provided with flanges 69 at both ends, and is attached to the cylinder block 30 by the flanges 69 being fixed to the cylinder block 30 with attaching bolts 70. The both end portions of the oil passage connection member 68 are inserted into attaching holes 71 formed in the cylinder block 30, and seal members such as O-rings 72 are interposed between both the end portions and the attaching holes 71. Interposition of the seal members prevents oil leakage between the upstream side divided passage portion 66A and the downstream side divided passage portion 66B, and the oil passage connection member 68. The oil passage connection member 68 is not limited to a pipe member, but may be a hose, a cast component, and a cut component.

As illustrated in FIG. 5, the sub oil passage 67 is formed to communicate with the upstream side divided passage portion 66A and the downstream side divided passage portion 66B of the main oil passage 66 and extend from the upstream side divided passage portion 66A and the downstream side divided passage portion 66B toward orifices 73 of the crank journal portions 51 of the cylinder block 30. Consequently, the lubricating oil in the upstream side divided passage portion 66A and the downstream side divided passage portion 66B of the main oil passage 66 is guided to the orifices 73 of the crank journal portions 51 through the sub oil passages 67, and thereby lubricates the crankshaft 26.

In the present embodiment, the sub oil passage 67 is configured by a pipe member 75 that is a separate member from the cylinder block 30 being inserted in a part or a whole (a part in the present embodiment) of an oil passage hole 74 formed in the cylinder block 30. The aforementioned oil passage holes 74 are preferably formed coaxially with the attaching holes 71 in which both the end portions of the oil passage connection member 68 are inserted.

The sub oil passage 67 may be formed by only the oil passage hole 74 in which the pipe member 75 is not present, but use of the pipe member 75 has an advantage as follows. That is, in the engine (the V-type engine) 11 in the outboard motor 10 of the present embodiment, the V bank angle θ of the left bank 27 and the right bank 28 is set to be a narrow angle of 90 degrees or less, and the cylinder diameters of the cylinders 33 in the respective banks 27 and 28 are formed to be large, and a displacement is set to be large. Consequently, the region between the left bank 27 and the right bank 28 in the cylinder block 30 has a thin wall thickness, and if the oil passage hole 74 is formed in this region, there is the fear that the lubricating oil flowing in the oil passage hole 74 leaks out to the cylinder 33 through a blow-hole. However, by configuring the sub oil passage 67 by inserting the pipe member 75 into the oil passage hole 74, there is provided an advantage of being able to reliably prevent leakage of the lubricating oil which flows in the sub oil passage 67.

Since the present embodiment is configured as above, effects (1) to (7) as follows are provided according to the present embodiment.

(1) As illustrated in FIGS. 3 and 5, when the V bank angle θ of the engine (the V-type engine) is an narrow angle of 90 degrees or less, the wall thickness of the region between the left bank 27 and the right bank 28 in the cylinder block 30 is thin, and it becomes difficult to form the continuous single main oil passage with the necessary passage diameter in the thin portion. However, according to the present embodiment, the main oil passage 66 is configured by connecting the upstream side divided passage portion 66A and the downstream side divided passage portion 663 which are divided partway in the axial direction by the oil passage connection member 68 which is a separate member from the cylinder block 30.

Thereby, even when the V bank angle θ of the engine (the V-type engine) 11 is a narrow angle, the oil passage (in particular, the main oil passage 66) that guides the lubricating oil to the bearing portions (crank journal portions 51) of the crankshaft 26 can be ensured with the simple structure. As a result, a number of processing steps for forming the oil passage (in particularly, the main oil passage 66) to the cylinder block 30 can be reduced, and a number of assembly steps of the engine 11 including the crankshaft lubricating oil passage structure 52 including the main oil passage 66 can be further reduced.

(2) As illustrated in FIGS. 4 and 5, the main oil passage 66 provided between the left bank 27 and the right bank 28 in the cylinder block 30 is configured by the upstream side divided passage portion 66A and the downstream side divided passage portion 66B which are formed in the cylinder block 30 being connected by the oil passage connection member 68 which is the separate member from the cylinder bloc 30. Further, the knock sensor 50 is directly installed between the left bank 27 and the right bank 28 in the cylinder block 30 in the state where the knock sensor is interposed between the cylinder block 30 and the oil passage connection member 68.

From the above, the oil passage connection member 68 of the main oil passage 66 is disposed in such a manner as to avoid the knock sensor 50, and the oil passage is not formed in the vicinity of the knock sensor 50, so that the knocking signal generated in the engine (the V-type engine) 11 is received by the knock sensor 50 with high sensitivity without being attenuated by the lubricating oil in the oil passage. Consequently, knocking which is generated in the engine (the V-type engine) 11 can be detected at low cost and with high precision by the signal knock sensor 50, and knocking prevention control can be favorably carried out based on the detection result.

(3) The knock sensor 50 is installed between the left bank 27 and the right bank 28 in the cylinder block 30 in the state where the knock sensor 50 is interposed between the cylinder block 30 and the oil passage connection member 68. The knock sensor 50 installed in the cylinder block 30 is covered with the oil passage connection member 68 in this way, a worker can carry out maintenance work without worrying about contact to the nock sensor 50 at the time of maintenance of the engine (the V-type engine) 11, so that maintenance workability of the engine 11 can be enhanced.

(4) As illustrated in FIG. 2, while in the engine (the V-type engine) 11, the catalyst converters 45 are disposed in the left exhaust passage 41 and the right exhaust passage 42, the V bank angle θ between the left bank 27 and the right bank 28 is set at a narrow angle of 90 degrees or less, whereby the dimension in the width direction of the engine (the V-type engine) 11 can be restrained, and the engine 11 can be made compact.

(5) The V bank angle θ of the left bank 27 and the right bank 28 of the engine (the V-type engine) 11 loaded on the outboard motor 10 is set at a narrow angle, and reduction in size of the engine 11 is realized, whereby the dimension in the outboard motor width direction of the outboard motor 10 can be restrained. As a result, even when the plurality of outboard motors 10 are provided side by side on the transom 20A of the hull 20 to be close to each other as illustrated in FIG. 6, and the hull 20 is turned as illustrated in FIG. 7, the space N between the outboard motors 10 is ensured, and thereby interference of the outboard motors 10 can be prevented. Consequently, maneuverability of the hull 20 by the outboard motors 10 can be enhanced.

(6) As illustrated in FIG. 5, the sub oil passages 67 in the crankshaft lubricating oil passage structure 52 are configured by the pipe members 75 being inserted into the oil passage holes 74 which extend to the crank journal portions 51 from the upstream side divided passage portion 66A and the downstream side divided passage portion 66B of the main oil passage 66. The region where the oil passage holes 74 are formed, between the left bank 27 and the right bank 28 in the cylinder block 30, is a region with a thin wall thickness sandwiched by the respective cylinders 33 of the left bank 27 and the right bank 28. Accordingly, the sub oil passages 67 are configured by the pipe members 75 being inserted into the oil passage holes 74, whereby the lubricating oil which flows in the sub oil passages 67 can be reliably prevented from leaking out into the cylinders 33.

(7) The attaching holes 71 in which both the end portions of the oil passage connection member 68 which configures the main oil passage 66 are inserted, and the oil passage holes 74 of the sub oil passage 67 are formed coaxially with each other. Accordingly, boring work for the attaching holes 71 and the oil passage holes 74 is facilitated, and workability thereof can be enhanced.

While the embodiment of the present invention is described thus far, the embodiment is presented as an example, and does not intend to limit the scope of the invention. The embodiment can be carried out in various other modes, and various omissions, replacements, and changes can be made within the range without departing from the gist of the invention. Further, the replacements and changes are included in the scope and gist of the invention, and are included in the scope of the invention described in the claims and the equivalents of the invention.

For example, in the engine (the V-type engine) 11 of the present embodiment, the cylinder block 30 includes the cylinders 33, and also functions as a crankcase half body. However, when the cylinder block includes the cylinders 33, but does not includes the function as the crankcase half body, the crank journal portions 51 are provided in a crankcase half body to which the cylinder block is joined, the knock sensor 50 is also installed, and further the upstream side divided passage portion 66A and the downstream side divided passage portion 66B of the main oil passage 66 in particular and the sub oil passages 67 of the crankshaft lubricating oil passage structure 52 are formed.

In this case, the oil passage connection member 68 which is a separate member from the crankcase half body in which the upstream side divided passage portion 66A and the downstream side divided passage portion 66B are formed is fixed to the aforementioned crankcase half body. Further, in this case, the pipe member 75 which is a separate member from the crankcase half body in which the oil passage hole 74 of the sub oil passage 67 is formed is inserted into the aforementioned oil passage hole 74, and thereby the sub oil passage 67 is configured.

Further, the crankshaft lubricating oil passage structure 52 of the V-shape engine in the present embodiment can be applied to an engine that is loaded on a motorcycle, a four-wheeled car or a water vehicle, or a general-purpose engine, without being limited to the engine loaded on the outboard motor 10.

What is claimed is:

1. A crankshaft lubricating oil passage structure of a V-shaped engine that supplies lubricating oil to a bearing portion of a crankshaft provided in a cylinder block or a crankcase, the V-shaped engine including a pair of banks, the pair of banks including cylinders and disposed in a V shape with respect to the crankshaft, a V bank angle as an included angle of the cylinders of the respective banks being set at a narrow angle, the crankshaft lubricating oil passage structure comprising:

a main oil passage provided between the pair of banks in the cylinder block or the crankcase; and a sub oil passage extending from the main oil passage to the bearing portion of the crankshaft and guiding the lubricating oil to the bearing portion, wherein the main oil passage is formed by connecting divided passage portions that are divided partway in an axial direction by an oil passage connection member that is a separate member from the cylinder block or the crankcase, and wherein the sub oil passage is formed by using a pipe member that is a separate member from the cylinder block or the crankcase.

2. The crankshaft lubricating oil passage structure for a V-shaped engine according to claim 1, wherein a knock sensor that detects knocking of the V-shaped engine is installed between the pair of banks in the cylinder block or the crankcase, in a state where the knock sensor is interposed between the cylinder block or the crankcase, and the oil passage connection member.

3. The crankshaft lubricating oil passage structure for a V-shaped engine according to claim 1, wherein the V-shaped engine is equipped with a catalyst for purifying exhaust gas.

4. The crankshaft lubricating oil passage structure for a V-shaped engine according to claim 1, wherein the V-shaped engine is loaded on an outboard motor.

* * * * *